US009861844B2

(12) United States Patent
Sieme et al.

(10) Patent No.: US 9,861,844 B2
(45) Date of Patent: Jan. 9, 2018

(54) METHOD AND SYSTEM FOR FIRE PREVENTION AND/OR FIRE FIGHTING

(75) Inventors: Martin Sieme, Hamburg (DE); Markus Piesker, Lueneburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 514 days.

(21) Appl. No.: 13/606,621

(22) Filed: Sep. 7, 2012

(65) Prior Publication Data

US 2013/0087347 A1 Apr. 11, 2013

Related U.S. Application Data

(60) Provisional application No. 61/532,593, filed on Sep. 9, 2011.

(30) Foreign Application Priority Data

Sep. 9, 2011 (DE) ..... 10 2011 113 057

(51) Int. Cl.

| | |
|---|---|
| ***A62C 2/00*** | (2006.01) |
| ***A62C 3/08*** | (2006.01) |
| ***A62C 5/00*** | (2006.01) |
| ***A62C 35/68*** | (2006.01) |

(52) U.S. Cl.

CPC ..... *A62C 3/08* (2013.01); *A62C 5/008* (2013.01); *A62C 35/68* (2013.01)

(58) Field of Classification Search

CPC ..... A62C 3/0207; A62C 3/08; A62C 3/07; B64D 13/00

USPC ..... 169/44, 45, 46, 62; 454/71, 76, 79

See application file for complete search history.

(56) References Cited

U.S. PATENT DOCUMENTS

| | | | | |
|---|---|---|---|---|
| 4,726,426 | A * | 2/1988 | Miller | A62C 3/08 169/16 |
| 5,934,379 | A * | 8/1999 | Østlyngen | A62C 3/07 169/46 |
| 2007/0221388 | A1* | 9/2007 | Johnson | A62C 35/58 169/16 |
| 2008/0064316 | A1* | 3/2008 | Ng | A62C 3/08 454/76 |
| 2008/0213634 | A1 | 9/2008 | Grundel | |
| 2009/0000329 | A1 | 1/2009 | Colberg | |
| 2009/0007578 | A1* | 1/2009 | Yabu | F24F 1/0003 62/190 |
| 2010/0251737 | A1 | 10/2010 | Roering | |

FOREIGN PATENT DOCUMENTS

| | | | | |
|---|---|---|---|---|
| DE | 10 2004 054 609 | | 10/2006 | |
| DE | 10 2005 054 888 | | 7/2007 | |
| DE | 10 2006 005 035 | | 9/2007 | |
| DE | 10 2009 011 797 | | 9/2010 | |
| EP | 2 105 166 | | 9/2009 | |
| JP | 2007-247924 | * | 9/2007 | F25B 49/02 |

* cited by examiner

*Primary Examiner* — Arthur O Hall
*Assistant Examiner* — Joel Zhou
(74) *Attorney, Agent, or Firm* — Dickinson Wright PLLC

(57) ABSTRACT

A method for fire prevention and/or fire fighting on board an aircraft comprises the steps detecting a fire event, leading an extinguishant to a fire source through a cooling-system piping system (12) which serves, in the normal operation of the aircraft, to supply a refrigerant to a cooling station (14*a*, 14*b*) and/or discharge a refrigerant from a cooling station (14*a*, 14*b*), and flooding the fire source with the extinguishant.

16 Claims, 2 Drawing Sheets

METHOD AND SYSTEM FOR FIRE PREVENTION AND/OR FIRE FIGHTING

Figure 1:
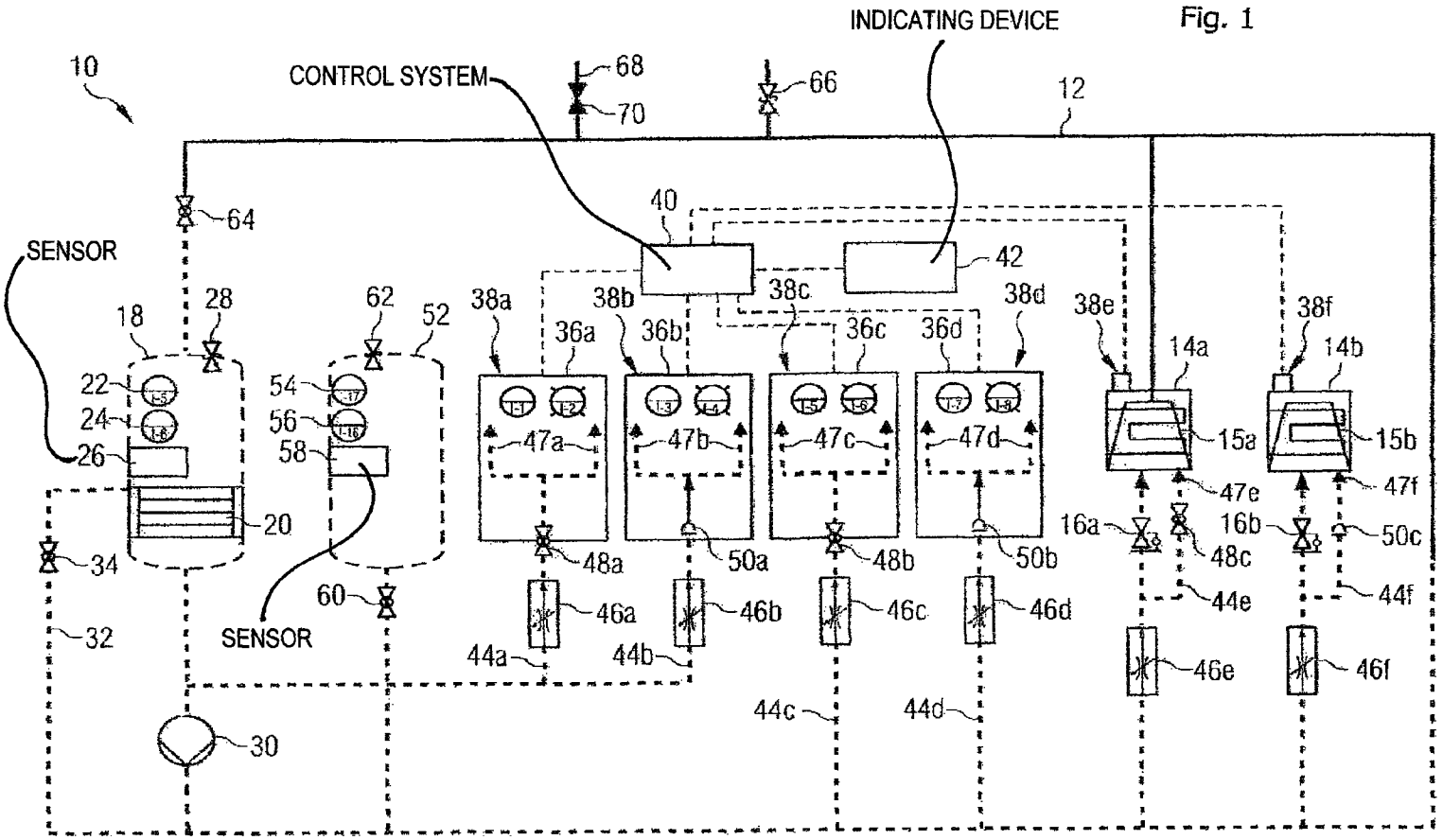

The invention relates to a method and a system for fire prevention and/or fire fighting on board an aircraft.

At present, a plurality of decentralised fire extinguishing systems are provided on board modern commercial aircraft. Each decentralised fire extinguishing system comprises at least one extinguishant tank filled with an extinguishant, normally a halogenated hydrocarbon. Furthermore, the fire extinguishing systems may comprise a fire warning system which monitors a closed space or a unit, for example an electronic system. If a fire warning system detects smoke or even a fire, for example by means of corresponding smoke or temperature sensors, the extinguishant tanks assigned to the corresponding fire warning system are triggered manually from the cockpit or automatically and the space monitored by the fire warning system or the unit monitored by the fire warning system is flooded with the extinguishant. Alternatively to this, however, the activation of fire extinguishing systems not equipped with a fire warning system may also take place purely manually, i.e. in these fire extinguishing systems the human sensitivity is considered to be sufficiently reliable to detect a fire risk or a fire that already exists by perceiving smoke or a smell of burning. Finally, for fire prevention in the region of an aircraft fuel tank, so-called inerting systems are known, which by supplying inert gas reduce the oxygen content and thereby the ignitability or flammability of the gas phase in the fuel tank or the atmosphere in the vicinity of the fuel tank. Such an inerting system is described, for example, in DE 10 2005 054 888 B4.

Moreover, aircraft cooling systems comprising a central refrigerating device and a plurality of cooling stations are known from the prior art, for example DE 10 2006 005 035 B3 or DE 10 2009 011 797 A1. The cooling stations are arranged at different positions, possibly also far apart from one another, for example in the region of the galleys, and serve for example to cool food provided for supplying to the passengers and stored in mobile transport containers. The cooling stations are supplied with cooling energy from the central refrigerating device. For this purpose, the central refrigerating device is connected to the individual cooling stations via a piping system in which a refrigerant circulates. A single-phase refrigerant, such as for example Galden® or a water-glycol mixture, can be employed as the refrigerant. Alternatively to this, however, a two-phase refrigerant, such as for example R744 ($CO_2$) or R134A ($CH_2F—CF_3$), can be employed.

The object on which the invention is based is to provide a method for fire prevention and/or fire fighting on board an aircraft, which enables a weight-optimised design of a corresponding system for fire prevention and/or fire fighting on board an aircraft. Furthermore, the object on which the invention is based is to specify a system for fire prevention and/or fire fighting on board an aircraft.

This object is achieved by a method for fire prevention and/or fire fighting on board an aircraft having the features of claim 1 and by a system for fire prevention and/or fire fighting on board an aircraft having the features of claim 8.

In a method according to the invention for fire prevention and/or fire fighting on board an aircraft, in a first step a fire event is detected. The fire event detection may take place manually, i.e. purely by the human sensitivity, for example by perceiving smoke or a smell of burning. Alternatively to this, however, a fire warning system may also be employed to detect a fire event, which system is preferably equipped with smoke and/or temperature sensors and is thereby capable of rapidly detecting a fire event. Moreover, a fire warning system used to monitor fuel tanks or an aircraft region in the vicinity of the fuel tanks may be equipped with corresponding sensors which are capable of detecting an increased fuel concentration in liquid or gaseous form in the vicinity of the fuel tanks. In the context of this application, a "fire event" is understood to mean not only a fire that already exists. Rather, in the context of this application, the term "fire event" also refers to a fire risk originating from a potential fire source. Similarly, the term "fire source" refers not only to a place at which a fire has already broken out, but also a place from which a potential fire risk originates.

In a fire event, i.e. if a fire risk or a fire at a fire source is detected by the fire warning system, an extinguishant is led to the fire source. To lead the extinguishant to the fire source, a cooling-system piping system which serves, in the normal operation of the aircraft, to supply a refrigerant to a cooling station and/or discharge a refrigerant from a cooling station is utilised. In other words, in the method according to the invention for fire prevention and/or fire fighting on board an aircraft, a part of a refrigerant circuit or the entire refrigerant circuit of a cooling system is used to supply the extinguishant to the fire source.

The cooling-system piping system may be assigned to a central or decentralised cooling system of the aircraft which serves, in the normal operation of the aircraft, to supply cooling energy generated by a refrigerating device to one or more cold energy consumers. The cooling-system piping system may extend throughout the entire aircraft and may be designed to withstand an elevated pressure acting on the piping system during operation of the cooling system. For example, the cooling system whose cooling-system piping system is utilised in a fire event to supply the extinguishant to the fire source may be a cooling system which serves, in the normal operation of the aircraft, to cool food stored in the region of the galley. Alternatively or additionally to this, however, the cooling system may also serve to supply other cooling energy consumers, such as for example electronic systems on board the aircraft, with cooling energy. The cooling-system piping system preferably is closed circuit which may be sealed from the ambient.

To supply the extinguishant, to be led to the fire source, into the cooling-system piping system, the cooling-system piping system may be connected to at least one extinguishant reservoir via at least one corresponding supply line. In each supply line, a valve for controlling the extinguishant flow through the supply line may be arranged. As will be explained in more detail below, a separate extinguishant reservoir for carrying out the method according to the invention for fire prevention and/or fire fighting on board an aircraft and realising a corresponding system for fire prevention and/or fire fighting on board an aircraft is, however, not absolutely necessary. Furthermore, the cooling-system piping system may be connected via at least one corresponding connecting line to at least one potential fire source, i.e. an aircraft region at risk of fire and/or an aircraft system at risk of fire, for example an electronic system or a fuel tank. In each connecting line, a valve for controlling the extinguishant flow through the connection line may be arranged.

The extinguishant supplied to the fire source through the cooling-system piping system is, finally, used to flood the fire source. By flooding the fire source with the extinguishant, a fire risk detected by the fire warning system can be averted or a fire that already exists can be extinguished. Moreover, if a suitable extinguishant is chosen, an inerting of aircraft regions at risk of fire, for example in the region of the fuel tanks, can be achieved.

By using a cooling-system piping system already present anyway on board the aircraft for leading the extinguishant to a fire source, the provision of decentralised extinguishant tanks filled with extinguishant can at least partly be dispensed with. As a result, weight and cost savings can be achieved. Moreover, through the cooling-system piping system, possibly aircraft regions and/or aircraft units, in the region of which it is not possible to arrange any decentralised extinguishant tanks due to installation restrictions, can be made accessible for extinguishant. Finally, it is conceivable to employ the method according to the invention for fire prevention and/or fire fighting on board an aircraft redundantly with hitherto customary safety systems, i.e. additionally to providing conventional decentralised extinguishant tanks. As a result, the safety on board the aircraft can be improved in a fire event.

In addition to the piping system of a cooling system present on board an aircraft also a piping system of a water supply system of the aircraft may be used to supply extinguishant to a fire source.

The method according to the invention for fire prevention and/or fire fighting on board an aircraft may provide that the refrigerant led through the cooling-system piping system in the normal operation of the aircraft is drained from the cooling-system piping system before the extinguishant is led through the cooling-system piping system to the fire source. In this case, it is conceivable to remove the refrigerant partially or completely from the cooling system. This is possible particularly if the refrigerant is a gaseous or liquid refrigerant which may be let out into the environment, optionally also outside the aircraft. Alternatively to this, however, the refrigerant may also be led out of the cooling-system piping system into a suitable storage tank. This has the advantage that the refrigerant is available for further use in the cooling system.

The storage tank may be a storage tank which serves, in the normal operation of the aircraft, for temporary storage of the refrigerant flowing through the cooling-system piping system. Alternatively to this, however, it is also possible to provide a separate storage tank which serves only in a fire event to temporarily store refrigerant drained from the cooling-system piping system. After filling with refrigerant from the cooling-system piping system, the storage tank may be shut off, for example by means of a suitable valve, and thereby separated from the cooling-system piping system.

Alternatively to this, however, the extinguishant may also be led through the cooling-system piping system together with the refrigerant led through the cooling-system piping system in the normal operation of the aircraft. The fire source can then be flooded with a mixture of extinguishant and refrigerant led through the cooling-system piping system in the normal operation of the aircraft. Such a method procedure is suitable particularly if the fire-preventing and/or fire-fighting effect of the extinguishant is not impaired by the refrigerant and aircraft components present in the region of the fire source are not undesirably damaged by the refrigerant.

Furthermore, it is possible for the refrigerant led through the cooling-system piping system in the normal operation of the aircraft to be used as propellant in order to convey the extinguishant through the cooling-system piping system to the fire source. Particularly if the refrigerant is kept under an elevated pressure with respect to the atmospheric pressure in the cooling-system piping system in the normal operation of the aircraft, the refrigerant may be utilised to put extinguishant, stored in an extinguishant reservoir, under an elevated pressure and thus convey the extinguishant out of the reservoir into the cooling-system piping system and finally to the fire source. The supply of the refrigerant to the extinguishant reservoir may be controlled by means of corresponding valves which may be arranged in connecting lines connecting the cooling-system piping system to the extinguishant reservoir. The utilisation of the refrigerant as propellant accelerates the conveyance of the extinguishant through the cooling-system piping system and optionally enables additional conveying devices to be dispensed with.

In case the piping system of a water supply system of the aircraft is used to supply extinguishant to a fire source, the water may be drained from the water supply system piping system before the extinguishant is lead through the water supply system piping system to the fire source or the extinguishant may be lead through the piping system of the water supply system together with the water flowing through the water supply system piping system in the normal operation of the aircraft. As a further alternative, it is also possible to use the water flowing through the water supply system piping system in the normal operation of the aircraft as propellant in order to convey the extinguishant through the piping system of the water supply system to the fire source.

As required, i.e. according to the nature of the fire source and seriousness of the fire event, different method procedures are possible. Thus, for example, in a first fire event it may be decided to flood the fire source with a mixture of extinguishant and refrigerant from the cooling-system piping system, which has the advantage that the draining of the refrigerant from the cooling-system piping system can be dispensed with and consequently a rapid flooding of the fire source can be effected. By contrast, in a second fire event, for example if components present in the region of the fire source may be excessively damaged by the flooding with the refrigerant, it may be decided firstly to remove the refrigerant from the cooling-system piping system and only then utilise the cooling-system piping system for supplying the extinguishant to the fire source. Finally, it is also possible to decide on the utilisation of the refrigerant as propellant individually, for example depending on the seriousness of the fire event and the nature of the fire source.

Similarly, it may be decided in dependence on the nature of the fire source and in dependence on the seriousness of the fire event, whether water flowing through the piping system of a water supply system on board the aircraft should be drained from the piping system of the water supply system before the extinguishant is lead therethrough, whether the estinguishant should be conveyed to the fire source together with the water flowing through the water supply system piping system in the normal operation of the aircraft or whether the water flowing through the water supply system piping system in the normal operation of the aircraft should be used as propellant in order to convey the extinguishant through the piping system of the water supply system to the fire source.

The decision on the method procedure may be made by the cockpit or cabin personnel. Alternatively, however, it is also conceivable to control the method procedure automatically via a corresponding electronic control system. The electronic control system then controls the method procedure preferably on the basis of signals characteristic of the seriousness and the other nature of the fire event, which signals may be supplied to the electronic control system by the fire warning system, for example. Furthermore, the electronic control system on controlling the method procedure may then access a data base in which data on possible fire sources, their nature etc. are stored.

In a particularly preferred embodiment of the method according to the invention, the refrigerant led through the cooling-system piping system in the normal operation of the aircraft is utilised as extinguishant in a fire event. In principle, various refrigerants in gaseous or liquid form are utilisable as extinguishants. The utilisation of the refrigerant as extinguishant enables the halogenated hydrocarbons which are currently employed as extinguishants, but are classed as harmful to the climate, to be dispensed with. Moreover, considerable weight and cost savings are possible, since the provision of additional extinguishant can be dispensed with. If the cooling system contains so much refrigerant that in a fire event a sufficient amount of refrigerant is available as extinguishant, the provision of additional tanks for storing refrigerant utilisable as extinguishant can be dispensed with. It is, however, also conceivable to provide the cooling system with one or more additional storage tanks in which may be stored refrigerant which may be employed in a fire event as extinguishant.

As required, i.e. according to the nature of the fire source and seriousness of the fire event, different method procedures are possible, i.e. in a first fire event, for example, it may be decided to utilise the refrigerant led through the cooling-system piping is system in the normal operation the aircraft as extinguishant. By contrast, in a second fire event another extinguishant may be utilised for fire fighting, which may be withdrawn for example from an extinguishant reservoir connected via a corresponding connecting line to the cooling-system piping system. In this way, once again the seriousness and the particular circumstances of the fire event and the nature of the fire source can be taken into account. The decision on the method procedure may once again be made by the cockpit or cabin personnel. Alternatively to this, however, it is also conceivable to control the method procedure automatically via a corresponding electronic control system.

Preferably, in the method according to the invention, a two-phase refrigerant is employed as the refrigerant led through the cooling-system piping system in the normal operation of the aircraft. A two-phase refrigerant is distinguished in that it is converted from the liquid to the gaseous state on releasing its cooling energy to the cooling station of the cooling system. Subsequently, the refrigerant is converted back to the liquid state again by corresponding pressure and temperature control in the cooling-system piping system. In the normal operation of the cooling system, a high cooling capacity can be achieved by a two-phase refrigerant, since a two-phase refrigerant can transport large amounts of heat away from the cooling station owing to its phase transition.

Some two-phase refrigerants may, however, also be readily employed as extinguishants. Moreover, two-phase refrigerants employed in cooling systems are usually kept at an elevated pressure in the normal operation of the cooling systems. In a fire event, the refrigerants then serving as extinguishants can therefore be transported to the fire source rapidly and without the use of additional conveying means, for example by opening a valve arranged in a connecting line connecting the cooling-system piping system to the fire source.

$CO_2$ is particularly suitable for combined use as refrigerant and extinguishant. $CO_2$ has the above-described advantages of a two-phase refrigerant and is, moreover, environmentally friendly, inexpensive and easy to produce. Furthermore, $CO_2$ is to suitable as extinguishant in the case of burning gases and liquids and, with sufficient concentration, also in the case of burning solids. A further advantage of using $CO_2$ as extinguishant is that $CO_2$ evaporates when it is released into the atmosphere in the solid state, without changing into the liquid state beforehand. Furthermore, $CO_2$ is not electrically conductive. $CO_2$ is therefore suitable as extinguishant particularly for electrical and electronic systems, since it does not cause any short circuits and evaporates without residue. In addition, $CO_2$ is usually kept under elevated pressure in the cooling-system piping system, so that the expansion of the $CO_2$ on its release is accompanied by a temperature reduction of the $CO_2$ and consequently a cooling of the fire source. Furthermore, additional propellant or the use of a conveying device for supplying the $CO_2$ to the fire source can be dispensed with. Finally, $CO_2$ is distinguished in that it does not react with other extinguishants or reduce their effectiveness. A further possible use of $CO_2$ as combined refrigerant/extinguishant is the inerting of aircraft fuel tanks and aircraft regions surrounding the fuel tanks. In particular at high outside temperatures, fuel held in the fuel tanks can evaporate, so that an ignitable gas mixture can form in the gas phase in the fuel tanks or in the atmosphere in aircraft regions adjacent to the fuel tanks. The method according to the invention may therefore provide for supplying $CO_2$, employed as refrigerant in the normal use of the aircraft, as extinguishant into a fuel tank or into an aircraft region adjacent to a fuel tank, if a corresponding fire warning system detects an increased fuel content in the gas phase in a fuel tank or in the atmosphere in the vicinity of a fuel tank. The supply of $CO_2$, employed as refrigerant in the normal operation of the aircraft, as extinguishant into a fuel tank or into an aircraft region adjacent to a fuel tank may also be provided as a back-up or redundancy solution in addition to an inerting system already present.

Through the $CO_2$ supply, the oxygen content of the gas phase in the fuel tank or in the atmosphere in the vicinity of the fuel tank is reduced. Consequently, the gas mixture becomes less readily or even no longer ignitable or flammable. Furthermore, the expansion of the $CO_2$, which is usually kept under elevated pressure in the cooling-system piping system, when it is supplied into a fuel tank or a vicinity of a fuel tank is associated with a temperature reduction of the $CO_2$. As a result, the $CO_2$ cools the tank and thus reduces the evaporation of fuel which occurs at high temperature and consequently the risk of the formation of an ignitable gas mixture.

In the method according to the invention for fire prevention and/or fire fighting on board an aircraft, the flooding of the fire source with extinguishant can take place at an interval or a plurality of intervals. The flooding of the fire source may be controlled manually by the cockpit or cabin personnel. Alternatively to this, however, an automatic control of the flooding of the fire source by means of a mechanical or electronic control system is also possible. An electronic control system controls the flooding of the fire source preferably on the basis of signals characteristic of the seriousness and the other nature of the fire event, which signals may be supplied to the electronic control system by the fire warning system, for example. Furthermore, the electronic control system on controlling the method procedure may then access a data base in which data on possible fire sources, their nature etc. is stored. Finally, an uncontrolled flooding of the fire source, for example using a bursting disc, is also conceivable.

A system according to the invention for fire prevention and/or fire fighting on board an aircraft comprises a cooling-system piping system which is designed, in the normal operation of the aircraft, to supply a refrigerant to a cooling station and/or discharge a refrigerant from a cooling station. The cooling-system piping system is furthermore designed to lead an extinguishant to a fire source in a fire event. The cooling-system piping system may consist of a train system or else a plurality of parallel trains of pipes or else a plurality of pipelines laid parallel, but separated from one another. Finally, the system according to the invention comprises a device for flooding the fire source with an extinguishant. Optionally, the system for fire prevention and/or fire fighting may furthermore comprise a fire warning system for detecting a fire event.

The system according to the invention for fire prevention and/or fire fighting on board an aircraft may further comprise a piping system of a water supply system present on board the aircraft.

The system according to the invention for fire prevention and/or fire fighting on board an aircraft may comprise a drain device which is designed to drain the refrigerant led through the cooling-system piping system in the normal operation of the aircraft from the cooling-system piping system before the extinguishant is led through the cooling-system piping system to the fire source. The drain device may comprise a discharge line which opens into the atmosphere, optionally also outside the aircraft, or a storage tank for receiving the refrigerant. Furthermore, a valve for controlling the refrigerant flow through the discharge line may be provided.

The cooling-system piping system may furthermore be designed to lead the extinguishant, together with the refrigerant led through the cooling-system piping system in the normal operation of the aircraft, to the fire source. The device for flooding the fire source with the extinguishant is then preferably designed to flood the fire source with a mixture of extinguishant and refrigerant led through the cooling-system piping system in the normal operation of the aircraft.

Finally, the cooling-system piping system may be designed to use the refrigerant led through the cooling-system piping system in the normal operation of the aircraft as propellant in order to convey the extinguishant through the cooling-system piping system to the fire source.

The system according to the invention for fire prevention and/or fire fighting on board an aircraft may further comprise a drain device which is designed to drain water lead through the piping system of the water supply system of the aircraft in the normal operation of the aircraft from the water supply system piping system before the extinguishant is lead through the water supply system piping system to the fire source. Furthermore, the water supply system piping system may be designed to lead the extinguishant, together with the water lead through the water supply system piping system in the normal operation of the aircraft, to the fire source. Finally, it is conceivable that the water supply system piping system is designed to use the water lead through the water supply system piping system in normal operation of the aircraft as propellant in order to convey the estinguishant through the water supply system piping system to the fire source.

The system according to the invention for fire prevention and/or fire fighting may be designed to utilise the refrigerant led through the cooling-system piping system in the normal operation of the aircraft as extinguishant in a fire event.

Preferably, in the system according to the invention for fire prevention and/or fire fighting on board an aircraft, a two-phase refrigerant, in particular $CO_2$, is employed as the refrigerant led through the cooling-system piping system in the normal operation of the aircraft.

The device for flooding the fire source with the extinguishant may be designed to flood the fire source with extinguishant at an interval or a plurality of intervals. The device for flooding the fire source may comprise at least one nozzle which is configured in such a way that the formation of ice in the region of an outlet opening of the nozzle is prevented. A proper supply of the extinguishant to the fire source is thereby guaranteed. Furthermore, the nozzle may be provided with a device which is designed to prevent an electrostatic charging of the medium flowing out. The risk of sparking due to electrostatic charging can thereby be averted or at least minimised.

Finally, the system according to the invention for fire prevention and/or fire fighting on board an aircraft may comprise a control system, formed in particular as an electronic control system. The control system may be designed to control the system operation as required, i.e. according to the nature of the fire source and seriousness and nature of the fire event, as described above in connection with the method according to the invention. In this case, the control system may utilise signals characteristic of the seriousness and the other nature of the fire event, which signals may be supplied to the electronic control system by the fire warning system, for example. Furthermore, the electronic control system on controlling the method procedure may access a data base in which data on possible fire sources, their nature etc. are stored.

Figure 2:
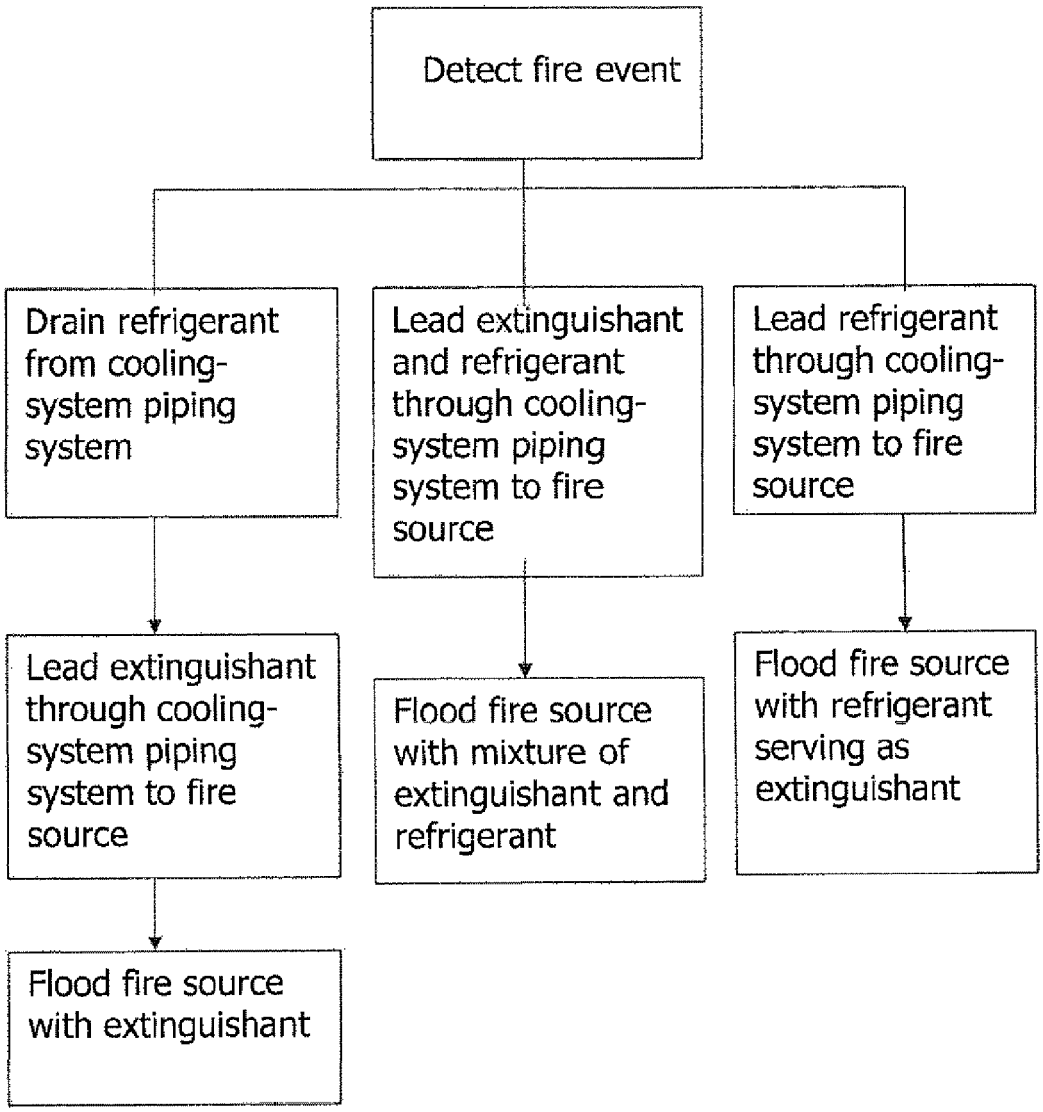

Preferred embodiments of the invention will now be explained in more detail with reference to the appended schematic drawings, of which FIG. 1 shows a general diagram of a system for fire prevention and/or fire fighting on board an aircraft, and FIG. 2 shows a flow chart in which a method for fire prevention and/or fire fighting on board an aircraft is illustrated.

FIG. 1 illustrates a system 10 for fire prevention and/or fire fighting on board an aircraft. The system 10 is designed as an integrated cooling system and fire prevention/fire fighting system. The system 10 comprises a cooling-system piping system 12, through which, in the normal operation of the aircraft, a refrigerant flows in order to supply cooling energy to two cooling stations 14*a*, 14*b* embodied as evaporators. The cooling stations 14*a*, 14*b* each comprise a heat exchanger 15*a*, 15*b*, through which the refrigerant, supplied to the cooling stations 14*a*, 14*b*, flows. On flowing through the heat exchangers 15*a*, 15*b* of the cooling stations 14*a*, 14*b*, the refrigerant releases cooling energy to corresponding cooling energy consumers, for example food stored in the region of the aircraft galleys. Alternatively to this, the cooling stations 14*a*, 14*b* may also serve to supply other cooling energy consumers on board the aircraft, for example electrical or electronic systems, with cooling energy. The supply of the refrigerant to the cooling stations 14*a*, 14*b* is controlled by control valves 16*a*, 16*b* which are each arranged upstream of the cooling stations 14*a*, 14*b* in the cooling-system piping system 12.

The refrigerant led through the cooling-system piping system 12 is a two-phase refrigerant, in particular $CO_2$. The refrigerant is supplied to the cooling stations 14*a*, 14*b* at least predominantly in the liquid state or as wet steam. On flowing through the heat exchangers 15*a*, 15*b* provided in the cooling stations 14*a*, 14*b*, the refrigerant evaporates, releasing its cooling energy to the cooling energy consumers supplied with cooling energy by the cooling stations 14*a*, 14*b*. In a region of the cooling-system piping system 12 arranged downstream of the cooling stations 14*a*, 14*b*, the refrigerant is therefore at least substantially in the gaseous state.

Furthermore, a storage tank 18 is arranged in the cooling-system piping system 12. A receiving space of the storage tank 18 is designed such that it can hold a part or the total amount of the refrigerant circulating through the cooling-system piping system 12. A heat exchanger 20, through which a further refrigerant flows, is arranged in the storage tank 18. The refrigerant held in the receiving space of the storage tank 18 is cooled, condensed and optionally also supercooled by cooling energy supplied to the storage tank 18 by the further refrigerant. Moreover, the storage tank 18 can perform the function of a separator for separating refrigerant in the liquid state from refrigerant in the gaseous state. Corresponding sensors 22, 24, 26 serve to detect the temperature, pressure and refrigerant level in the storage tank 18. High pressures may arise in the storage tank 18, in particular at high ambient temperatures. The storage tank 18 is therefore designed for high pressures. A pressure relief valve 28 serves, if necessary, to reduce the pressure in the storage tank 18.

A conveying device 30 embodied, for example, in the form of a pump is arranged in the cooling-system piping system 12 downstream of the storage tank 18. The conveying device 30 serves to convey refrigerant predominantly in the liquid state from the storage tank 18 and, in the normal operation of the system 10, supply it to the cooling stations 14*a*, 14*b*. Furthermore, the conveying device 30 can be used to return refrigerant withdrawn from the storage tank 18 to the storage tank 18 via a bypass line 32. The refrigerant flow through the bypass line 32 can be controlled by means of a bypass valve 34 arranged in the bypass line 32. If necessary, the conveying device 30 can also be operated such that it supplies a part of the refrigerant withdrawn from the storage tank 18 to the cooling stations 14*a*, 14*b* and returns a part of the refrigerant withdrawn from the storage tank 18 to the storage tank 18 again via the bypass line 32.

FIG. 1 furthermore illustrates a plurality of aircraft regions 36*a-d* presenting potential fire risks. The aircraft region 36*a* is a closed space, whereas the aircraft regions 36*b* and 36*c* are formed by units presenting potential fire risks, such as, for example, electrical or electronic aircraft systems. The aircraft region 36*d* is a fuel tank. Finally, in the illustration according to FIG. 1, the cooling stations 14*a*, 14*b* configured as evaporators are also classed as aircraft regions presenting potential fire risks.

A fire warning system 38*a-f* is assigned to each aircraft region 36*a-d* and each cooling stations 14*a*, 14*b*. The fire warning systems 38*a-f* each comprise corresponding sensors which acquire measured values allowing conclusions to be drawn about the presence of a fire risk or about a fire risk that already exists. The sensors can be, for example, smoke or temperature sensors. Furthermore, the fire warning system 38*d* assigned to the aircraft region 36*d* configured as a fuel tank is equipped with a sensor for detecting the fuel concentration in a gas phase in the fuel tank. The signals output by this sensor allow conclusions to be drawn about the presence of an ignitable or flammable gas mixture in the fuel tank. Finally, each fire warning system 38*a-f* is equipped with a signalling system which emits audible and/or visible signals in order to point out a fire risk or a fire that already exists to people situated in the vicinity of the aircraft regions 36*a-d* or the cooling stations 14*a*, 14*b*.

The signals output by the sensors of the fire warning systems 38*a-f* are supplied to an electronic control system 40. The control system 40 processes the signals and reports the presence of a fire risk or a fire that already exists to a corresponding indicating device 42 situated in the cockpit of the aircraft.

Each of the aircraft regions 36*a-d* is connected to the cooling-system piping system 12 via a connecting line 44*a-d*. The connecting lines 44*a* and 44*b* assigned to the aircraft regions 36*a* and 36*b* branch off from the cooling-system piping system 12 immediately downstream of the storage tank 18. By contrast, the branching-off points of the connecting lines 44*a* and 44*b* assigned to the aircraft regions 36*c* and 36*d* lie downstream of the conveying device 30. Finally, each cooling station 14*a*, 14*b* is assigned a connecting line 44*e*, 44*f* which each branches off from the cooling-system piping system 12 upstream of the control valve 16*a*, 16*b* for controlling the refrigerant supply into the cooling stations 14*a*, 14*b*. A flow limiter 46*a-d* is arranged in each connecting line 44*a-d*. Further flow limiters 46*e-f* assigned to the cooling stations 14*a*, 14*b* are situated in the cooling-system piping system 12 upstream of the branching-off of the connecting lines 44*e*, 44*f* from the cooling-system piping system 12.

The connecting lines 44*a-f* serve to supply an extinguishant to the aircraft regions 36*a-d* and to the cooling stations 14*a*, 14*b* via corresponding flooding devices 47*a-f*, configured in the form of nozzles, in a fire event, i.e. in the event of a fire risk or a fire that already exists. The flooding of the aircraft regions 36*a-d* and of the cooling stations 14*a*, 14*b* with the extinguishant in a fire event is effected in the case of the aircraft regions 36*a* and 36*c* and in the case of the cooling station 14*a* by controlling shutoff valves 48*a-c* arranged in the connecting lines 44*a* and 44*c*, and 44*e*, respectively. By contrast, in the case of the aircraft regions 36*b* and 36*d* and in the case of the cooling station 14*b*, automatic triggering devices 50*a-c* are provided, which automatically flood the aircraft regions 36*b* and 36*d* and the cooling station 14*b* with the extinguishant when a fire event is detected by the fire warning systems 38*b*, 38*d* and 38*f*.

The refrigerant stored in the storage tank 18 and serving, in normal operation, to cool the cooling stations 14*a*, 14*b* may serve as the extinguishant. Additional extinguishant, which may be either likewise the refrigerant serving, in normal operation, to cool the cooling stations 14*a*, 14*b*, but also another extinguishant, is stored in a reservoir 52. In similar fashion to the storage tank 18, the reservoir 52 is equipped with corresponding sensors 54, 56, 58 for detecting the temperature, pressure and extinguishant level in the reservoir 52. A shutoff valve 60 serves to control the extinguishant discharge from the reservoir 52. Finally, a pressure relief valve 62 is present, which serves, if necessary, to reduce the pressure in the reservoir 52.

Finally, a shutoff valve 64 and a pressure relief valve 66 are provided in the cooling-system piping system 12 upstream of the storage tank 18. Furthermore, a drain line 68, in which a drain valve 70 is arranged, is connected to the cooling-system piping system 12.

In the following, the operation of the system 10 illustrated in FIG. 1 is explained. In the normal operation of the system 10, i.e. when there is no fire event, the system 10 is operated as a cooling system. For this purpose, refrigerant which is at least predominantly in the liquid state is supplied from the storage tank 18 to the cooling stations 14*a*, 14*b* by means of the conveying device 30. On flowing through the heat exchangers 15*a*, 15*b* of the cooling stations 14*a*, 14*b*, the refrigerant releases cooling energy to corresponding cooling energy consumers and in the process is converted into the gaseous state. Refrigerant leaving the cooling stations 14*a*, 14*b* in the gaseous state is recirculated into the storage tank 18, where it is cooled or supercooled and thereby converted back into the liquid state again. The recirculation of the refrigerant from the cooling stations 14*a*, 14*b* into the storage tank 18 can be controlled with the aid of the shutoff valve 64. An undesired excess pressure in the cooling-system piping system 12 can be reduced via the pressure relief valve 66 as appropriate.

If one of the fire warning systems 38*b*, 38*d*, 38*f* detects a fire event, the corresponding triggering device 50*a*, 50*b*, 50*c* automatically ensures an immediate flooding of the aircraft regions 36*b*, 36*d* and of the cooling station 14*b*. Furthermore, the control system 40 ensures that the pilots in the cockpit are informed about the fire event via the indicating device 42. The flow limiters 46*b*, 46*d*, 46*f* ensure a permanent, stable supply of the fire source with extinguishant and reduce the risk of the flooding devices 47*b*, 47*d*, 47*f*, configured in the form of nozzles, icing up. Furthermore, the design of the flooding devices 47*b*, 47*d*, 47*f*, configured in the form of nozzles, reduces the icing risk. The signalling system of the fire warning systems 38*b*, 38*d*, 38*f* emit audible and/or visible signals in order to point out the fire event to people situated in the vicinity of the fire source. Such a method procedure illustrated on the right in FIG. 2 means that the refrigerant circulating in the cooling-system piping system 12, in the normal operation of the system, performs a dual function and serves as extinguishant in a fire event.

If the amount of refrigerant serving as extinguishant held in the storage tank 18 and the cooling-system piping system 12 is sufficient for the fire prevention and/or fire fighting in the aircraft regions 36*b*, 36*d* and the cooling station 14*b*, the shutoff valve 60 can remain closed, thereby preventing additional extinguishant from being led out of the reservoir 52 into the cooling-system piping system 12. By contrast, if additional extinguishant is required for the fire prevention and/or fire fighting in the aircraft regions 36*b*, 36*d* and the cooling station 14*b*, it is possible, optionally under the control of the control system 40, for the shutoff valve 60 downstream of the reservoir 52 to be opened and thereby the supply of extinguishant from the reservoir 52 into the cooling-system piping system 12 to be enabled. The extinguishant stored in the reservoir 52 can in this case correspond to the refrigerant circulating in the cooling-system piping system 12 in the normal operation of the system 10 or be another extinguishant.

In the case of the aircraft region 36*d* configured in the form of a fuel tank, the extinguishant can serve for fire fighting, but also for inerting the fuel tank. The latter is possible in particular when using $CO_2$ as refrigerant or extinguishant. By supplying $CO_2$ into the fuel tank, the oxygen content of the gas phase in the fuel tank and consequently the ignitability or flammability of the gas mixture is reduced. Moreover, the expansion of the $CO_2$, which is normally kept under elevated pressure in the cooling-system piping system 12, is associated with a temperature reduction of the $CO_2$ as it is supplied into the fuel tank. As a result, the $CO_2$ cools the tank and thus reduces the evaporation of fuel which occurs at high ambient temperatures and consequently the risk of formation of an ignitable gas mixture.

By contrast, if one of the fire warning systems 38*a*, 38*c*, 38*e* detects a fire event, the flooding of the aircraft regions 36*a*, 36*c* and of the cooling station 14*a* is controlled by corresponding control of the shutoff valves 48*a-c*. The flooding of the aircraft regions 36*a*, 36*c* and of the cooling station 14*a* can be effected at an interval or a plurality of intervals. In this case, different method procedures are possible. The method procedure can be decided on individually in the cockpit. Alternatively to this, however, an automatic control of the method procedure by means of the control system 40 is also possible. For this purpose, the control system 40 evaluates the signals supplied to it by the sensors of the fire warning system 38*a*, 38*c*, 38*e*. Furthermore, the control system 40 takes account of data, stored in a data base, on the design of the aircraft regions 36*a*, 36*c* and of the cooling station 14*a*.

In an alternative method procedure, illustrated on the left in FIG. 2, firstly the refrigerant present in the cooling-system piping system 12 can be drained from the cooling-system piping system 12. For this purpose, the drain valve 70 arranged in the drain line 68 is opened. Subsequently, the shutoff valve 60 assigned to the reservoir 52 is opened, thereby enabling the supply of extinguishant from the reservoir 52 into the cooling-system piping system 12. Finally, the shutoff valve 48*a-c* assigned to the fire source is opened. The flooding of the fire source then takes place as described above in connection with the flooding of the aircraft regions 36*b*, 36*d* and of the cooling station 14*b*. Such a method procedure is suitable particularly when an extinguishant is held in the reservoir 52 which differs from the refrigerant circulating in the cooling-system piping system 12 in the normal operation of the system and the refrigerant circulating in the cooling-system piping system 12 in the normal operation of the system is not suitable for fire prevention and/or fire fighting in the aircraft regions 36*a*, 36*c* and the cooling station 14*a*.

In a further alternative method procedure, illustrated in the middle in FIG. 2, by contrast a draining of the refrigerant present in the cooling-system piping system 12 from the cooling-system piping system 12 is dispensed with. Instead, merely the shutoff valve 60 assigned to the reservoir 52 is opened and extinguishant is supplied from the reservoir 52 into the cooling-system piping system 12. Furthermore, the shutoff valve 48*a-c* assigned to the fire source is opened. A mixture of refrigerant and extinguishant then flows through the cooling-system piping system 12 and the fire source is flooded with this mixture of refrigerant and extinguishant. The flooding of the fire source takes place once again as described above in connection with the flooding of the aircraft regions 36*b*, 36*d* and the cooling station 14*b*. Such a method procedure is expedient particularly when a rapid flooding of the fire source is required and the refrigerant does not impair the fire-preventing or fire-fighting effect of the extinguishant.

Finally, in a fire event in the aircraft regions 36*a*, 36*c* and the cooling station 14*a*, as in a fire event in the aircraft regions 36*b*, 36*d* and the cooling station 14*b*, the refrigerant circulating in the cooling-system piping system 12 in the normal operation of the system can also perform a dual function and serve as extinguishant in a fire event.

In a further alternative method procedure (not illustrated in the figures), the refrigerant led through the cooling-system piping system 12 in the normal operation of the system 10 is used as propellant in order to convey the extinguishant from the reservoir 52 through the cooling-system piping system 12 to the fire source. For this purpose, for example refrigerant under an elevated pressure with respect to the atmospheric pressure can be led out of storage tank 18 into the reservoir 52.

The invention claimed is:

1. A method for fire prevention and/or fire fighting on board an aircraft, comprising:

detecting a fire event, leading an extinguishant to a fire source through a cooling-system piping system, supplying a refrigerant to a cooling station and/or discharging the refrigerant from a cooling station via the cooling-system piping system before the extinguishant is led through the cooling-system piping system in the normal operation of the aircraft, draining the refrigerant from the cooling-system piping system into a storage tank before the extinguishant is led through the cooling-system piping system to the fire source, and wherein an amount of the refrigerant is used as the extinguishant.

2. The method according to claim 1, wherein the extinguishant is led through the cooling system piping system together with the refrigerant led through the cooling-system piping system in the normal operation of the aircraft, and the fire source is flooded with a mixture of extinguishant and refrigerant led through the cooling-system piping system in the normal operation of the aircraft.

3. The method according to claim 1, wherein the refrigerant led through the cooling-system piping system in the normal operation of the aircraft is used as propellant in order to convey the extinguishant through the cooling-system piping system to the fire source.

4. The method according to claim 1, wherein the refrigerant led through the cooling-system piping system in the normal operation of the aircraft is utilised as extinguishant in a fire event.

5. The method according to claim 1, wherein a two-phase refrigerant, in particular CO2, is employed as the refrigerant led through the cooling-system piping system in the normal operation of the aircraft.

6. The method according to claim 1, wherein the flooding of the fire source with extinguishant takes place at an interval or a plurality of intervals.

7. A system for fire prevention and/or fire fighting on board an aircraft, having:

a detection device configured to detect a fire event, a cooling-system piping system which is configured to, in the normal operation of the aircraft, (a) supply a refrigerant to a cooling station and/or discharge a refrigerant from a cooling station, and (b) lead an extinguishant to a fire source in response to the detection device detecting the fire event, and a supply device configured to supply the cooling-piping system with the extinguishant, a drain device including a valve to drain the refrigerant, that is led through the cooling-system piping system in the normal operation of the aircraft, from the cooling-system piping system into a storage tank, and a controller including a computer readable medium having instructions for causing a computer to execute a method to control the valve of the drain device to drain the refrigerant from the cooling-system piping system before the extinguishant is led through the cooling-system piping system to the fire source wherein an amount of the refrigerant is used as the extinguishant.

8. The system according to claim 7, wherein the cooling-system piping system is configured to lead the extinguishant, together with the refrigerant led through the cooling-system piping system in the normal operation of the aircraft, to the fire source, and in that the device for flooding the fire source with the extinguishant is configured to flood the fire source with a mixture of extinguishant and refrigerant led through the cooling-system piping system in the normal operation of the aircraft.

9. The system according to claim 7, wherein the cooling-system piping system is configured to use the refrigerant led through the cooling-system piping system in the normal operation of the aircraft as propellant in order to convey the extinguishant through the cooling-system piping system to the fire source.

10. The system according to claim 7, wherein the system is configured to utilise the refrigerant led through the cooling-system piping system in the normal operation of the aircraft as extinguishant in a fire event.

11. The system according to claim 7, wherein a two-phase refrigerant, in particular CO2, is employed as the refrigerant led through the cooling-system piping system in the normal operation of the aircraft.

12. The system according to claim 7, wherein the device for flooding the fire source with the extinguishant is structured to flood the fire source with extinguishant at an interval or a plurality of intervals.

13. The system according to claim 7, further comprising a control system which is configured to control the operation of the system for fire prevention and/or fire fighting on board an aircraft in dependence on signals characteristic of the seriousness and the other nature of the fire event and/or in dependence on data on the nature of the fire.

14. The method according to claim 1, wherein the amount of the refrigerant used as extinguishant is led through the cooling-system piping in the normal operation of the aircraft.

15. The system according to claim 7, wherein the amount of the refrigerant used as extinguishant is led through the cooling-system piping in the normal operation of the aircraft.

16. A method for fire prevention and/or fire fighting on board an aircraft, comprising:

detecting a fire event, leading an extinguishant to a fire source from a storage tank through a cooling-system piping system, which serves, in the normal operation of the aircraft, to supply a refrigerant to a cooling station and/or discharge the refrigerant from a cooling station, if an amount of extinguishant in the storage tank is insufficient, opening a shutoff valve assigned to a reservoir, such that the reservoir supplies extinguishant to the cooling system piping system, flooding the fire source with the extinguishant, wherein an amount of the refrigerant is used as the extinguishant.

* * * * *